United States Patent [19]

Eversdijk

[11] Patent Number: 4,706,719

[45] Date of Patent: Nov. 17, 1987

[54] FUNNEL

[76] Inventor: Aarnoud W. Eversdijk, Wijkselaan 4, 2554 GE, The Hague, Netherlands

[21] Appl. No.: 916,486

[22] PCT Filed: Jan. 21, 1986

[86] PCT No.: PCT/NL86/00003

§ 371 Date: Sep. 18, 1986

§ 102(e) Date: Sep. 18, 1986

[87] PCT Pub. No.: WO86/04318

PCT Pub. Date: Jul. 31, 1986

[30] Foreign Application Priority Data

Jan. 21, 1985 [NL] Netherlands ..... 8500149

[51] Int. Cl.[4] ..... B65B 3/04

[52] U.S. Cl. ..... 141/98; 141/337; 206/216

[58] Field of Search ..... 141/86, 337, 331, 332, 141/333, 334, 335, 336, 338, 339, 340, 341, 342, 343, 344, 345, 98, 325, 326, 327; 206/216

[56] References Cited

U.S. PATENT DOCUMENTS 4,402,401 9/1983 Leno ..... 141/86

FOREIGN PATENT DOCUMENTS 628000 3/1936 Fed. Rep. of Germany ..... 141/337

*Primary Examiner*—Houston S. Bell, Jr.
*Attorney, Agent, or Firm*—John P. Snyder

[57] ABSTRACT

The funnel (1) can be stored away compactly without cleaning and without danger of soiling and has a wall (12) which at least partially encases the collecting space and which on its lower side makes a close fitting connection onto a spout envelope (20).

20 Claims, 12 Drawing Figures

FUNNEL

Figure 1:
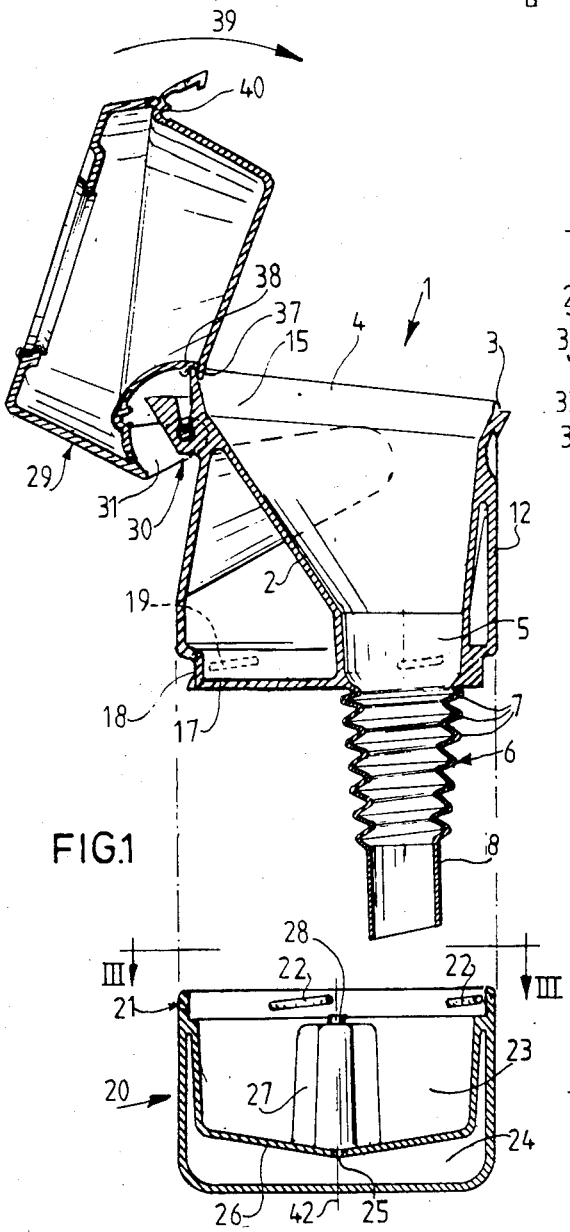

The invention relates to a funnel comprising a container bounding a collecting space and connecting via an outlet onto a spout which has a filling opening on its upper side which can be closed by a close fitting cover and which is larger than the outlet opening.

Such a funnel is known for example from U.S. Pat. No. 3,986,538. Because of its convergent shape this funnel is difficult to hold in place in the hand. While funnels in general must be cleaned after use to prevent soiling the surroundings with oil or the like, this cleaning is unnecessary with the funnel known from U.S. Pat. No. 3,986,538, because its spout protrudes close fitting through a cover of the funnel. A long hose is thereby used which makes the funnel bulky.

The invention has for its object to provide a funnel which after use can be stored away compactly without cleaning and without danger of soiling. To this end the funnel according to the invention is characterized by a wall which at least partially encases the collecting space and which on its lower side makes a close fitting connection onto a spout envelope. Such a funnel can be used by a car driver on the road for topping up the engine crankcase with oil and can be stored away after use in a small baggage space without the danger of his baggage being soiled. The outside of the funnel remains clean so that it can be used repeatedly without intermediate cleaning and with the hands remaining clean.

If the cover is a closable casing connected with a container, accessories such as filters or spout nozzles can be stored in it.

If the spout has folds it can be accommodated in compressed state in a small spout envelope.

If the spout holder is arranged inside the collecting holder the spout envelope can be removed from the container without the danger of dripping.

In order to be able to hold the funnel according to the invention firmly in place during use the convergent container is preferably encased by a hand grip. The funnel is easy to hold in the hand if a finger recess and a thumb recess are arranged under a collar of the convergent container.

Mentioned and other characteristics of the invention will be elucidated in the hereafter following description of preferred embodiments of a funnel according to the invention.

Figure 4:
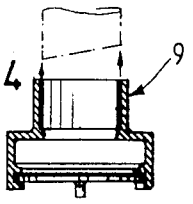
Figure 5:
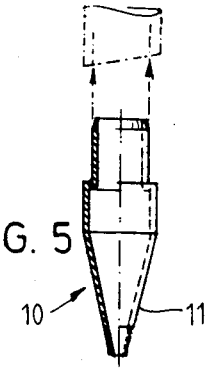
Figure 2:
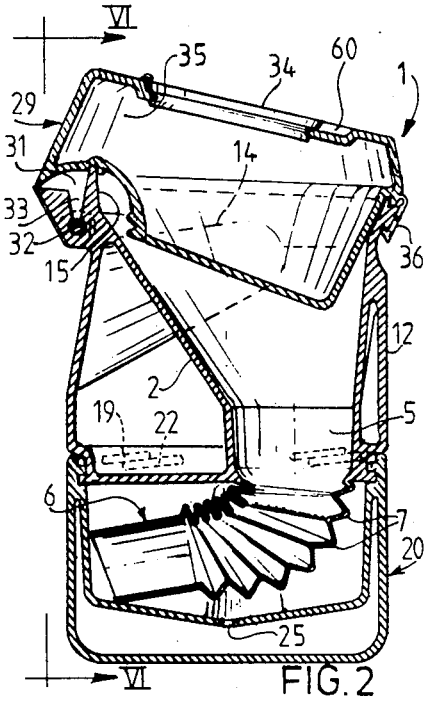
Figure 3:
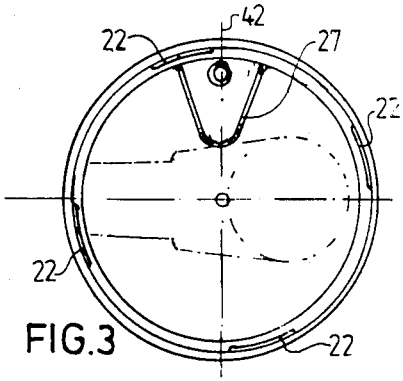
Figure 6:
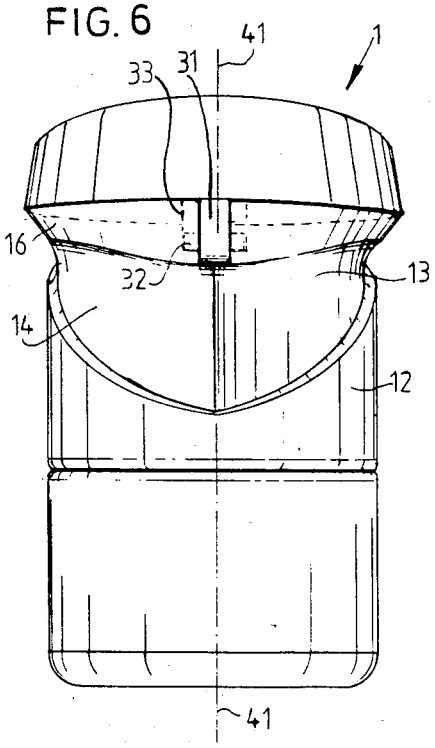
Figure 10:
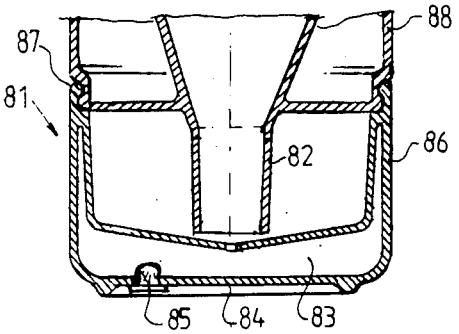
Figure 7:
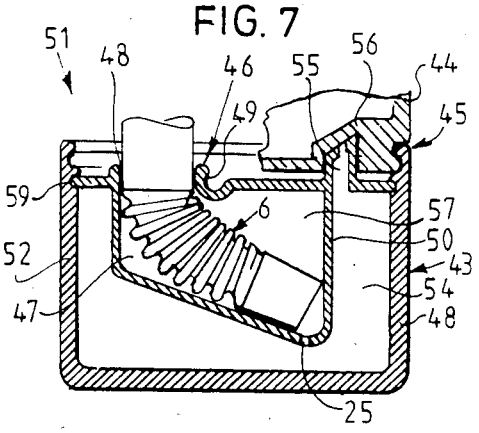
Figure 9:
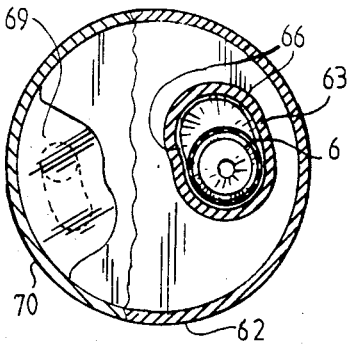
Figure 8:
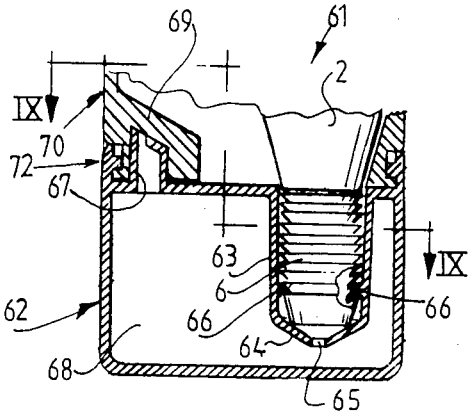
Figure 12:
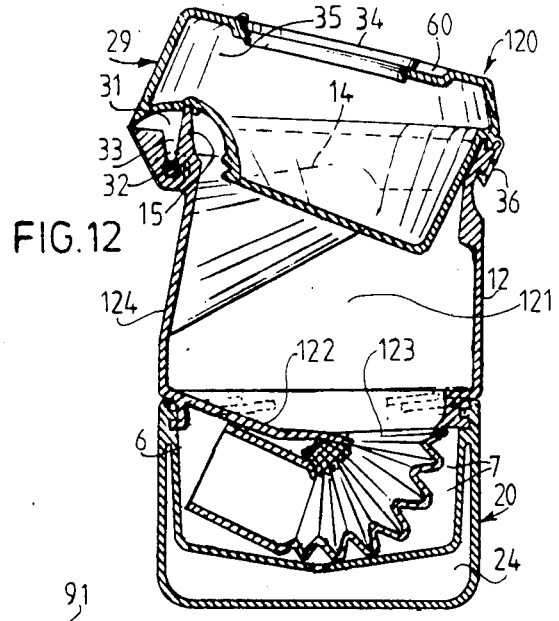
Figure 11:
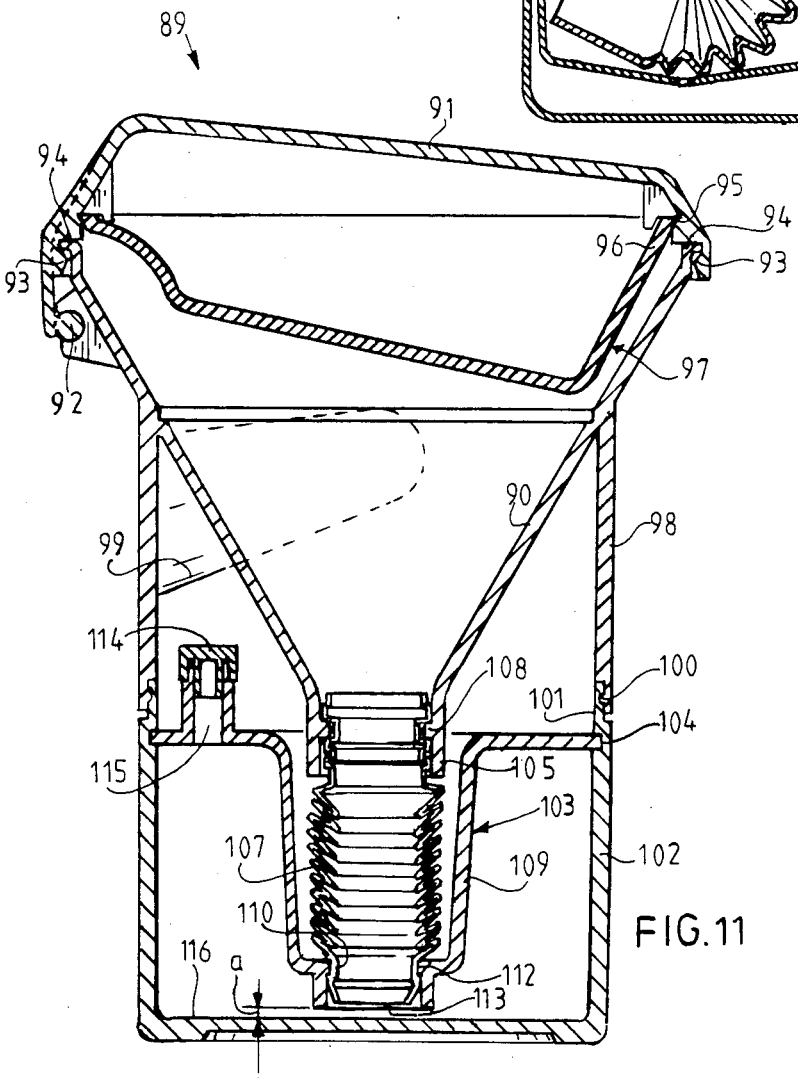

In the drawing:

FIGS. 1 and 2 show a vertical section through respectively an opened and closed funnel according to the invention, FIG. 3 shows a view according to arrows III in FIG. 1, FIGS. 4 and 5 show accessories for use with the funnel in FIG. 1, FIG. 6 shows a view according to arrows VI in FIG. 2, FIGS. 7, 8 and 10 show a vertical section through the lower part of in each case a different funnel according to the invention, FIG. 9 shows a section through line IX from FIG. 8, and FIG. 11 and 12 each show a section of in each case a different funnel according to the invention.

The funnel 1 in FIGS. 1–3 comprises an asymmetrical downwardly converging container 2 which has on its upper side a filling opening 4 bounded by a closing edge 3 and which on its lower side connects by means of an outlet 5 onto a spout 6 which has folds 7. These folds 7 together form a continuous screw, so that remnants of liquid can flow downwards along the screw. The lower end of spout 6 is a discharge opening 8 onto which can be attached, if required, accessories such as a filter 9 (FIG. 4) or a nozzle 10 with converging outlet end 11 (FIG. 5).

Funnel 1 comprises a hand grip 12 which encases container 2 and which has a finger recess 13 and a thumb recess 14 under a collar 15 of container 2. Using this hand grip 12 funnel 1 can be held firmly before, during and after use, whereby the danger of spilling liquid is greatly reduced. Hand Grip 12 is connected by means of a bottom wall 17 with outlet 5 of container 2. Hand grip 12 has a lower edge set with screw thread parts 19 with which hand grip 12 and with it container 2 can be connected for release with a spout envelope 20 which is provided for this purpose with an adapted upper edge having screw thread parts 22. Spout envelope 20 consists of a collecting holder 24 for collecting leaking liquid and a spout holder 23 arranged inside it for accommodation therein of spout 6 (FIG. 2). The residual liquid flowing out of spout 6 can run out of spout holder 23 via a small opening arranged in the bottom 26 of spout holder 23 into collecting holder 24. Collecting holder 24 has a pouring spout 27 with an outlet 28 which is closed off by the base 17 of hand grip 12. Thanks to folds 7 spout 6 can be accommodated in its deformed state in quite a small spout holder 23.

Filling opening 4 of container 2 is closed in FIG. 2 by cover 29. Cover 29 has a hinge member 31 which is connected for pivoting with container 2 by means of a pin 32 gripping in a snap recess 33. Cover 29 is a casing 35 closable by a member 34 for storing away the accessories in FIGS. 4 and 5. Cover 29 has a fastener hook 36 and a recess 60 enabling member 34 to be gripped with a thumb. FIG. 1 shows that cover 29 in the opened position strikes with a stop 37 against the inside of edge 3 and has a snap protrusion with which it can be set and held in place during use in a stable manner against a wind direction 36.

In the closed position of FIG. 2 edge 3 of container 4 makes a close fitting connection onto an edge 40 of cover 29 so that funnel 1, which has not been cleaned but is closed, remains clean outside and can be stored away with the baggage of the car driver without danger of soiling the surrounding area.

The funnel is preferably manufactured of polythene, which is acid and oil resistant.

Cover 29, container 2 with hand grip 12 and spout 6, and spout envelope 20 each consist of two form piece halves to be sealed together along section planes 41, 41 and 42 respectively, whereby the plastic of container 2 with hand grip 12 and spout 6 preferably has a colour other than that of cover 29 and spout envelope 20.

The variant of the lower end according to FIG. 7 of the funnel 51 has a snap coupling 45 between hand grip 44 and envelope 43 instead of a screw connection. Spout holder 47 is provided with a grip member 46 gripping onto spout 6, the member consisting of a ring collar which encircles the entrance 48 into spout holder 47 and which automatically extends spout 6 when it is pulled out. When inserted, spout 6 is automatically compressed. This spout envelope 43 consists of an outer casing 52 and an inner casing 50 of transparent plastic connected into the outer casing by means of a snap coupling 59. Collecting holder 54 is located between both these elements and has a spout shaped outlet 55 which is closed by a closing member 56 of hand grip 44.

The variant of the lower end of funnel 61 according to FIGS. 8 and 9 has a spout envelope 62 with a spout holder 63 which has a kidney shaped horizontal section and which close to the bottom 64 with opening 65 has interior edges 66, which, as gripping members, grip onto spout 61 provided with folds for extending the spout during its withdrawal from spout holder 63.

The outlet spout 67 of collecting holder 68 is closed off by a kidney shaped closing member 69 of hand grip 70. Because of the kidney form of closing member 69 and spout holder 67 envelope 62 can be connected with hand grip 70 so as to be releasable by means of a screw connection 72.

The lower end of the funnel 81 shown in FIG. 10 has a collecting holder 83 which is closed by an elastic stopper 85 arranged in the base 84. Envelope 86 is connected to hand grip 88 by means of a snap coupling 87. The spout 82 can be short and non-deformable or can if required contain a windable hose or can be telescopic.

Funnel 89 in FIG. 11 has a symmetrical converging container 90 to which is pivotally attached at hinge 92 a cover 91 which snaps into close fitting position with a snap-in edge 93 around the upper edge 94 of container 90. An inner groove 95 of cover 91 snap accommodates an edge 96 of a storage holder 97, for example for supplementary tools. A cylindrically round hand grip 98 ergonomically adapted to the hand and having some measure of finger and thumb configuration 99 encases container 90 and snap connects into place by means of an edge 100 onto the upper edge 101 of a collecting holder 102 with a groove 104 into which a spout envelope 103 is snap attached.

On an inner edge 108 of outlet 105 of container 90 a spout 107 is firmly snap coupled with its upper collar. The compressed concertina spout 107 is accommodated in a tube of spout envelope 103 while a lower collar 110 is held in place on its lower edge with snap co-operation by an inner edge 112 of tube 109, with a light grip, however, such that, with pulling on container 90, the hand grip 98 is first released from collecting holder 102, spout 107 is then pulled out and spout 107 is then pulled free of inner edge 112.

Oil leaking out of container 90 and through spout 107 after use then flows through the open end 113 of spout envelope 103 into collecting holder 102, which can be emptied via a discharge opening 115 that can be closed by means of a cap 114. The interval a between end 113 and base 116 of collecting holder 102 is so small that, as a result of adhesion, oil is drawn easily along base 116 into collecting holder 102.

The funnel 120 in FIG. 12 is highly similar to funnel 1, with the understanding that the collecting space 121 is substantially cylindrical with a form that is ergonomically adapted to the hand, while only its base 122 converges to an outlet opening 123. The hand grip 124 is also the wall of the collecting space 121.

I claim:

1. Funnel (1) comprising a container (2) bounding a collecting space and connecting via an outlet (5) onto a spout (6) which has a filling opening (4) on its upper side which can be closed by a close fitting cover (29) and which is larger than the outlet opening (5), characterized by a wall (12) which at least partially encases the collecting space and which wall (12) on its lower side makes a close fitting connection onto a spout container (20).

2. Funnel (1) as claimed in claim 1, characterized in that the cover (29) is a closable casing (35) connected with the container (2).

3. Funnel (1) as claimed in claim 1, characterized in that the spout (6) has folds (7).

4. Funnel (1) as claimed in claim 1, characterized in that the spout envelope (20) comprises a spout holder (23) and a collecting holder (24) connected thereto for leaking liquid, whereby said spout holder (23) is arranged preferably inside said collecting holder (24).

5. Funnel (1) as claimed in claim 1, characterized in that the spout envelope (20) can be connnected with the container (2) so as to be releasable.

6. Funnel (1) as claimed in any of the foregoing claims characterized in that a hand grip (12) encases the convergent container (2).

7. Funnel (1) as claimed in claim 6, characterized in that the hand grip (12) has a finger recess (13) and a thumb recess (14) which are arranged preferably beneath a collar (15) of the convergent container (2).

8. Funnel (1) as claimed in claim 4, characterized in that the collecting holder (24) has an outlet (28) which is closed off by a hand grip (12).

9. Funnel (1) as claimed in claim 1, characterized in that the spout (6) has folds (7) and is accommodated in a spout holder (23) which is provided with a gripping member (46) onto said spout (6).

10. Funnel (1) as claimed in claim 4, characterized in that the collecting holder (54) is bounded by an element (50) of transparent plastic.

11. A funnel device which comprises the combination of a body having a bottom wall provided with an opening, a spout projecting downwardly from said opening, means including an upstanding wall connected to said bottom wall for defining a funnel mouth leading to said opening, cover means for removably closing said funnel mouth, and spout container means removably engaged with said bottom wall for containing said spout.

12. A funnel device as defined in claim 11 wherein said cover means is hingedly connected with said body.

13. A funnel device as defined in claim 12 wherein said said spout is provided with a flexible bellows portion.

14. A funnel device as defined in claim 11 wherein said spout container means includes a spout holder and a liquid collection chamber in communication therewith, the spout holder being nested within said liquid collection chamber.

15. A storable funnel assembly comprising the combination of a main body having an outer wall portion shaped for ease of gripping and manipulation and defining a funnel chamber therewithin into which liquid is to be received, a spout extending downwardly from said main body for directing liquid from said funnel chamber into an entity which is to receive the liquid, removable cover means for removably closing the mouth of said funnel chamber to prevent leakage of liquid from the assembly through the mouth of the funnel chamber when the assembly is to be stored, and removable spout container means for removably enclosing said spout to prevent leakage of liquid from the assembly through the spout when the assembly is to be stored.

16. A storable funnel assembly as defined in claim 15 wherein said spout is deformably collapsible within said spout container means to a position therewithin to drain liquid into said spout container means, said spout container means having a first compartment into which liquid may drain directly from said spout and a second compartment into which liquid may drain and collect from said first compartment.

17. A storable funnel assembly as defined in claim 16 wherein said cover means is in the form of a container having a lid and within which accessories may be stored.

18. A storable funnel assembly as defined in claim 16 wherein said first compartment is provided with a pouring spout in communication with said second compartment, said pouring spout having a discharge opening which is engaged and closed by said body when said spout container means is engaged with said body in enclosing relation to said spout.

19. A storable funnel assembly as defined in claim 18 wherein said outer wall is generally cylindrical.

20. A storable funnel assembly as defined in claim 19 wherein said outer wall includes thumb and finger depressions for gripping the assembly.

* * * * *